US010087710B2

(12) United States Patent
Greci et al.

(10) Patent No.: US 10,087,710 B2
(45) Date of Patent: Oct. 2, 2018

(54) TUBING ASSEMBLY WITH A TEMPORARY SEAL

(71) Applicant: HALLIBURTON ENERGY SERVICES, INC., Houston, TX (US)

(72) Inventors: Stephen Michael Greci, Little Elm, TX (US); Michael Linley Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 256 days.

(21) Appl. No.: 14/910,458

(22) PCT Filed: Oct. 23, 2013

(86) PCT No.: PCT/US2013/066341
§ 371 (c)(1),
(2) Date: Feb. 5, 2016

(87) PCT Pub. No.: WO2015/060838
PCT Pub. Date: Apr. 30, 2015

(65) Prior Publication Data

US 2016/0177636 A1 Jun. 23, 2016

(51) Int. Cl.
*E21B 43/08* (2006.01)
*E21B 34/06* (2006.01)

(52) U.S. Cl.
CPC ..... *E21B 34/063* (2013.01); *E21B 34/06* (2013.01)

(58) Field of Classification Search
CPC ..... E21B 34/063; E21B 17/20; E21B 33/12; E21B 34/06
See application file for complete search history.

(56) References Cited

U.S. PATENT DOCUMENTS

| | | | | |
|---|---|---|---|---|
| 4,285,398 | A * | 8/1981 | Zandmer | E21B 43/11 166/100 |
| 8,403,052 | B2 | 3/2013 | Veit | |
| 2005/0103382 | A1 | 5/2005 | Carter | |
| 2005/0171488 | A1 | 8/2005 | Weaver et al. | |
| 2007/0295507 | A1 | 12/2007 | Telfer et al. | |
| 2009/0290971 | A1 | 11/2009 | Shamseldin et al. | |
| 2011/0083860 | A1 | 4/2011 | Gano et al. | |

OTHER PUBLICATIONS

International Patent Application No. PCT/US2013/066341 , International Search Report and Written Opinion, dated Jul. 15, 2014, 8 pages.

* cited by examiner

*Primary Examiner* — Brad Harcourt

(74) *Attorney, Agent, or Firm* — Kilpatrick Townsend & Stockton LLP

(57) ABSTRACT

A tubing assembly can include a pressure holding barrier with an opening between a first and a second area of the pressure holding barrier. The opening can define a passageway. A deformable stop can be positioned within the passageway that restricts fluid flow through the passageway. The deformable stop can be responsive to an application of pressure from the first area of the pressure holding barrier above a pre-set threshold by deforming. The deformable stop, when deformed, can restrict fluid flow from the first area of the pressure holding barrier to a second area of the pressure holding barrier.

20 Claims, 5 Drawing Sheets

TUBING ASSEMBLY WITH A TEMPORARY SEAL

CROSS-REFERENCE TO RELATED APPLICATIONS

This is a U.S. national phase under 35 U.S.C. § 371 of International Patent Application No. PCT/US2013/066341, titled "Tubing Assembly with a Temporary Seal" and filed Oct. 23, 2013, the entirety of which is incorporated herein by reference.

TECHNICAL FIELD

The present disclosure relates generally to wellbore assemblies, and more specifically (although not necessarily exclusively), to tubing assemblies including screen joints with inflow control devices.

BACKGROUND

During well drilling and completion tubing or piping can be run into the wellbore of well traversing a hydrocarbon-bearing subterranean formation. Tools or other assemblies can be run downhole and set by introducing a pressure in the tubing. If the tubing assembly includes screens or other openings, the openings can prevent a pressure seal between an inner area and an outer area of the tubing. Without the pressure seal between the inner and outer area of the tubing, an application of pressure in the inner area of the tubing can prevent a tool from setting in response to the application of pressure.

DETAILED DESCRIPTION

Figure 1:
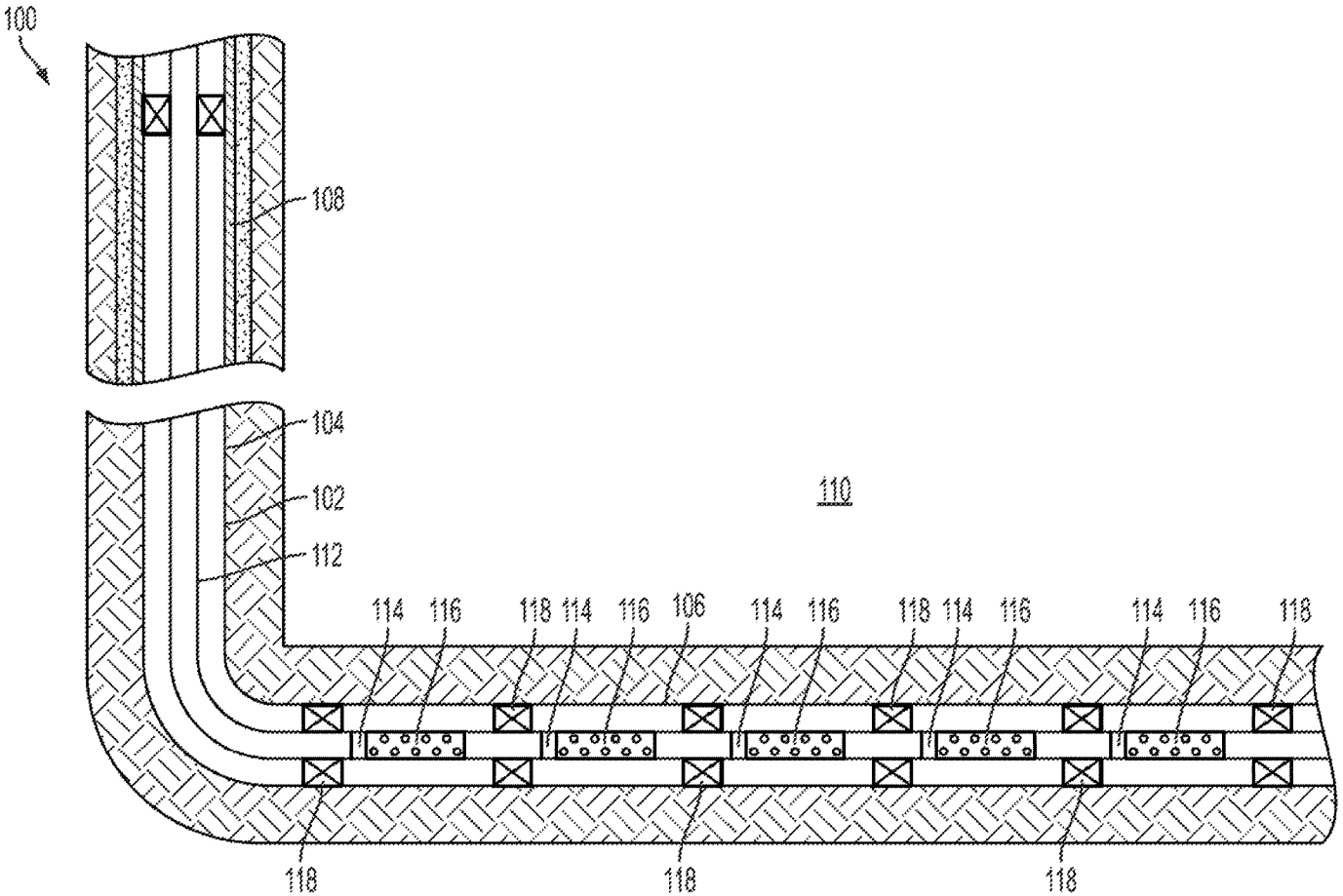
FIG. 1 is a schematic illustration of a well system having a tubing assembly according to one aspect.

Certain aspects and features relate to tubing assemblies that include screen assemblies with inflow control devices. The tubing assembly can include an opening in a tubing or a pipe of the tubing assembly. The opening can define a passageway. A plug having a pair of interior walls can be positioned within the opening and can also define the passageway. A deformable stop can be positioned within the opening and can temporarily restrict fluid flow through a flow path. In another aspect, the deformable stop can be positioned within the plug. The tubing assembly can include a screen assembly for filtering formation fluid that is positioned around the pipe of the tubing assembly. Additional tools, such as packers, can be included in the tubing assembly. The tools can be set from the surface of the wellbore using various stimuli, including for example the application of pressure.

A tubing assembly that includes a screen assembly can lack a pressure seal between an inner area of a pipe of the tubing assembly and an outer area of the pipe. Downhole tools may fail to activate in response to a pressure application within the pipe when the tubing assembly lacks a pressure seal between the inner area of the pipe and the outer area of the pipe. Temporarily sealing the tubing assembly such that there is a pressure seal between the inner area and the outer area of the pipe can allow the application of pressure to set a tool. The tubing assembly can be un-sealed when the pressure seal between the inner area and outer area of the pipe is no longer desired.

In one aspect, a tubing assembly can have a temporary pressure seal between an inner area of a pipe of the tubing assembly and an outer area of the pipe. The tubing assembly can include a plug positioned within an opening in the pipe that extends from the inner area of the pipe to the outer area of the pipe. The inner area of the pipe can correspond to a tubing area. The outer area of the pipe can correspond to an annular area. The plug can include a deformable stop that can initially be in a closed position. In another aspect, the deformable stop can be positioned within the opening itself.

The deformable stop positioned within the plug in the closed position can provide a pressure seal between the inner area and the outer area of the pipe. The pressure seal can allow a packer or other completion tools to be set. The deformable stop can also restrict flow from the inner area to the outer area of the pipe and from the outer area to the inner area of the pipe. The deformable stop can respond to an application of pressure above a pre-set threshold from the inner area of the pipe. For example, after the completion tool is set, an application of pressure above a pre-set threshold can be applied to the inner area of the pipe. The deformable stop can respond to the application of pressure above a pre-set threshold by deforming into a deformed position.

The deformable stop in the deformed position can restrict flow from the inner area to the outer area of the pipe. The deformable stop in the deformed position can also maintain a pressure seal between the inner and the outer area of the pipe. The deformable stop in the deformed position can respond to an application of pressure from the outer area of the pipe by dislodging from the plug. For example, fluid flowing from the outer area of the pipe to the inner area of the pipe can dislodge the deformable stop. A flow path through the plug between the outer area of the pipe and the inner area of the pipe can be formed when the deformable stop is dislodged from the plug.

The plug can be manufactured from a material that does not deform in response to an application of pressure beyond a pre-set threshold amount. The deformable stop can be manufactured from a deformable material that deforms in response to an application of pressure beyond the pre-set threshold amount. The deformable material can include materials that have a negative Poisson's ratio. The thickness of the deformable stop can be adjusted based on the material from which it is manufactured to correspond to a desired pre-set threshold of pressure.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present invention.

FIG. 1 depicts a well system 100 including a bore that is a wellbore 102 extending through various earth strata. The wellbore 102 has a substantially vertical section 104 and a substantially horizontal section 106. The substantially vertical section 104 and the substantially horizontal section 106 may include a casing string 108 cemented at an upper portion of the substantially vertical section 104. The substantially horizontal section 106 extends through a hydrocarbon bearing subterranean formation 110.

A tubing assembly includes a tubing string 112 or pipe extending from the surface within wellbore 102. The tubing string 112 can provide a conduit for formation fluids to travel from the substantially horizontal section 106 to the surface. Screen assemblies 116 can be positioned around the tubing string 112 in various production intervals. Fluid flow control devices 114 can be positioned adjacent the screen assemblies 116. On each side of each screen assembly 116 is a packer 118 that can provide a fluid seal between the tubing string 112 and the wall of the wellbore 102.

Figure 2:
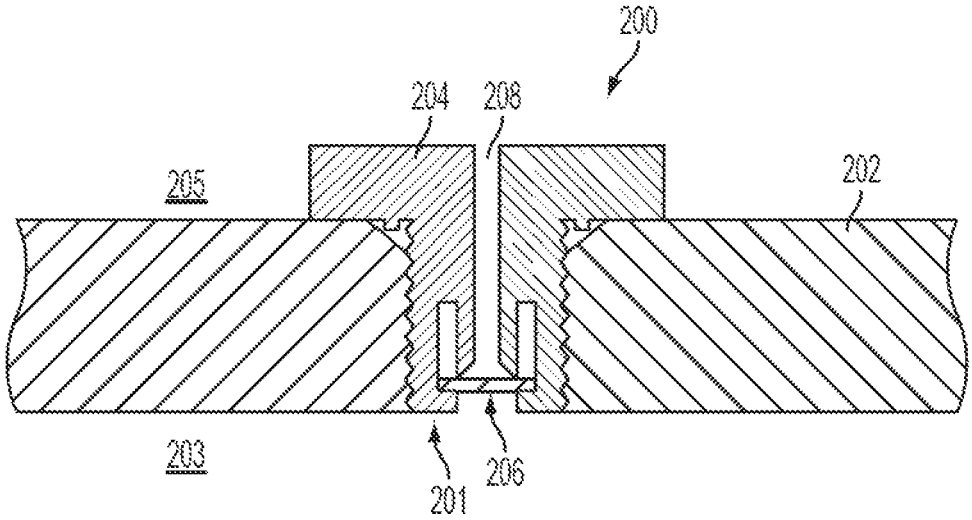
FIG. 2 is a cross-sectional view of part of a tubing assembly with a plug and a deformable stop in a closed position according to one aspect.
Figure 3:
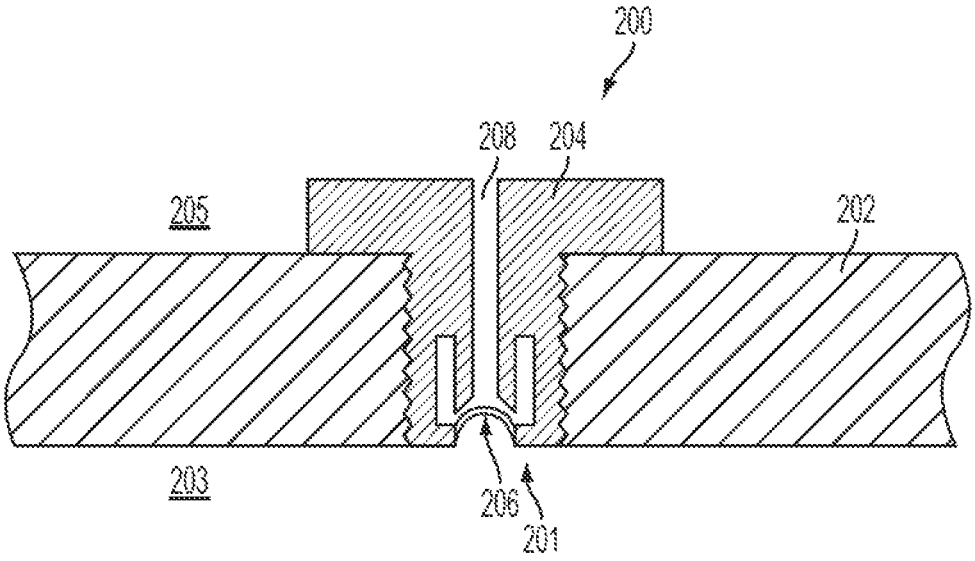
FIG. 3 is a cross-sectional view of the part of the tubing assembly of FIG. 2 with the deformable stop in a deformed position according to one aspect.
Figure 4:
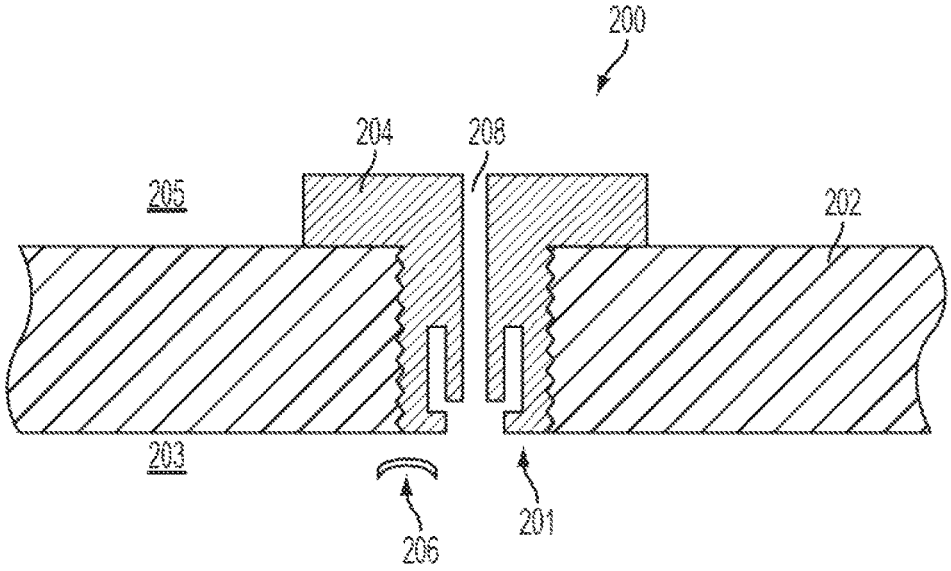
FIG. 4 is a cross-sectional view of part of the tubing assembly of FIG. 2 with the deformable stop dislodged from the plug according to one aspect.

FIGS. 2-3 cross-sectionally depict part of a tubing assembly 200 that includes a pipe 202 having an opening 201, a plug 204 positioned within the opening 201. A deformable stop 206 is disposed within the plug 204. The plug 204 includes a passageway or cavity that defines a flow path 208 between an inner area 203 of the pipe 202 and an outer area 205 of the pipe 202. The passageway that defines the flow path 208 is linearly shaped, but in other aspects can be a hyperboloid, an ellipsoid, a spheroid, a cube, a rectangle, or a triangle shape. The plug 204 is a single piece of material. In other aspects, the plug 204 can be constructed in multiple parts. The deformable stop 206 is positioned in the flow path 208 proximate to the inner area 203 of the pipe 202. In other aspects, the deformable stop 206 can be positioned at other locations within the flow path 208.

FIG. 2 depicts the deformable stop 206 in a closed position within the plug 204, which may be an initial position when the tubing assembly 200 is run into the wellbore. The deformable stop 206 in the closed position is undeformed and is positioned in the flow path 208. The deformable stop 206 in the closed position can restrict fluid flow through the flow path 208, from the inner area 203 of the pipe 202 to the outer area 205 of the pipe 202. The deformable stop 206 in the closed position can also restrict fluid flow through the flow path 208 and from the outer area 205 of the pipe 202 to the inner area 203 of the pipe 202. The deformable stop 206 in the closed position can provide a pressure seal between the inner area 203 of the pipe 202 and the outer area 205 of the pipe 202. The deformable stop 206 can be responsive to a change in a pressure in the inner area 203 of the pipe 202 by deforming into a deformed position. For example, the deformable stop 206 can deform when the pressure in the inner area 203 of the pipe 202 exceeds a pre-set threshold amount.

FIG. 3 depicts the plug 204 with the deformable stop 206 in the deformed position. The deformable stop 206 can include a material that has a negative Poisson's ratio that deforms in a known manner when pressure is applied to the material above a pre-set threshold. The deformable stop 206 in the deformed position can have a diameter that is less than the diameter of the deformable stop 206 in the closed position. The deformable stop 206 in the deformed position can restrict fluid flow from the inner area 203 of the pipe 202 to the outer area 205 of the pipe 202 through the flow path 208. The deformable stop 206 in the deformed position can also continue to provide a pressure seal between the inner area 203 of the pipe 202 and the outer area 205 of the pipe 202.

When the deformable stop 206 is in the deformed position fluid can flow from the outer area 205 of pipe 202 to the inner area 203 of pipe 202 through the flow path 208. Fluid flowing from the outer area 205 of the pipe 202 to the inner area 203 of pipe 202 through the flow path 208 can dislodge the deformable stop 206 from the plug 204. Fluid may flow through the flow path 208 originating from either the inner area 203 of the pipe 202 or the outer area 205 of the pipe 202 when the deformable stop 206 is dislodged from the plug 204 and is no longer disposed in the flow path 208.

Figure 5:
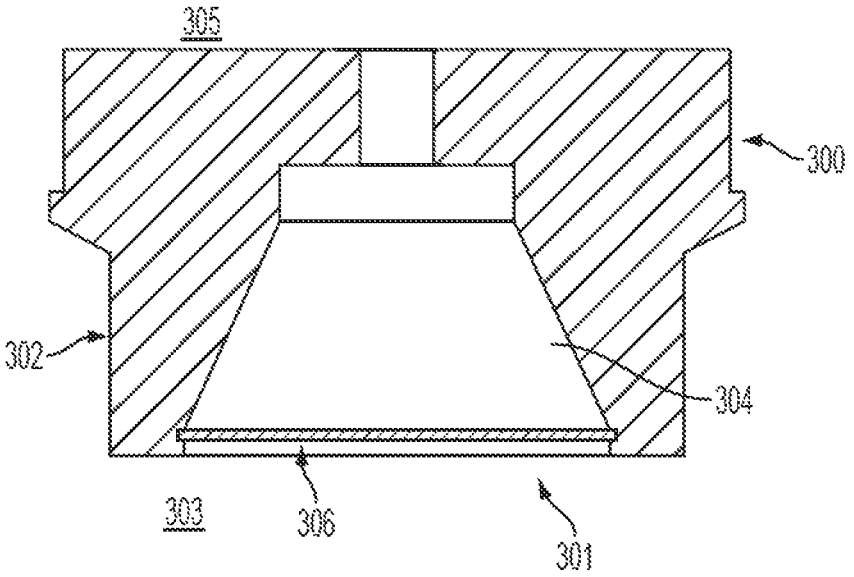
FIG. 5 is a schematic view of part of a tubing assembly with a plug and a deformable stop in a closed position according to another aspect.

FIG. 5 schematically depicts part of a tubing assembly 300 that includes a pipe 302 having an opening 301, a plug 304 positioned with the opening 301, and a deformable stop 306 positioned within the plug 304. The plug 304 includes a passageway that defines a flow path between an inner area 303 of the pipe 302 and an outer area 305 of the pipe 302. The plug 304 is conically shaped, though in other aspects the plug 304 can be of any suitable shape. The plug 304 is constructed of two pieces of material, in other aspects the plug 304 can be constructed in a single part or piece of material. The inner area 303 of the pipe 302 can correspond to a tubing side of the pipe 302. The outer area 305 of the pipe 302 can correspond to an annulus side of the pipe 302. The deformable stop 306 is positioned in the flow path proximate to the inner area 303 of the pipe 302. In other aspects, the deformable stop 306 can be positioned at other locations within the flow path of the plug 304.

FIG. 5 depicts the deformable stop 306 in a closed position within the plug 304, which may be an initial position when the tubing assembly 300 is run into the wellbore. The deformable stop 306 in the closed position is undeformed and is positioned in the flow path of the plug 304. The deformable stop 306 in the closed position can restrict fluid flow through the flow path, from the inner area 303 of the pipe 302 to the outer area 305 of the pipe 302. The deformable stop 306 in the closed position can also restrict fluid flow through the flow path and from the outer area 305 of the pipe 302 to the inner area 303 of the pipe 302. The deformable stop 306 in the closed position can also provide a pressure seal between the inner area 303 of the pipe 302 and the outer area 305 of the pipe 302. The deformable stop 306 can be responsive to a change in a pressure in the inner area 303 of the pipe 302. For example, the deformable stop 306 can deform when the pressure in the inner area 303 of the pipe 302 exceeds a pre-set threshold amount. The deformable stop 306 can be comprised of a material that has a negative Poisson's ratio that deforms in a known manner when pressure is applied to the material above a pre-set threshold.

The deformable stop 306 can deform into a deformed position when the pressure in the inner area 303 of the pipe 302 exceeds a pre-set threshold amount. The deformable stop 306 in the deformed position can have a diameter that is less than the diameter of the deformable stop 306 in the closed position. The deformable stop 306 in the deformed position can restrict fluid flow from the inner area 303 of the pipe 302 to the outer area 305 of the pipe 302 through the flow path. The deformable stop 306 in the deformed position can also provide a pressure seal between the inner area 303 of the pipe 302 and the outer area 305 of the pipe 302. Fluid can flow from the outer area 305 of pipe 302 to the inner area 303 of pipe 302 through the flow path of the plug 304 when the deformable stop 306 is in the deformed position. Fluid flowing from the outer area 305 of the pipe 302 to the inner area 303 of pipe 302 through the flow path 308 can dislodge the deformable stop 306 in the deformed position from the plug 304. Fluid can flow through the flow path originating from either the inner area 303 of the pipe 302 or the outer area 305 of the pipe 302 when the deformable stop 306 is dislodged from the plug 304 and is no longer disposed in the flow path.

In one aspect, a tubing assembly can include a pressure holding barrier with an opening between a first area and a second area of the pressure holding barrier. The opening can define a passageway. A deformable stop can be positioned within the passageway that restricts fluid flow through the passageway. The deformable stop can be responsive to an application of pressure from the first area of the pressure holding barrier above a pre-set threshold by deforming. The deformable stop, when deformed, can restrict fluid flow from the first area of the pressure holding barrier to a second area of the pressure holding barrier.

In another aspect, a tubing assembly can include a pipe having an opening. A plug can be disposed in the opening. The plug can include a cavity defining a flow path through the plug. The tubing assembly can also include a deformable stop disposed within the flow path. The deformable stop can restrict fluid flow when in a closed position and when in a deformed position.

In another aspect, a tubing assembly can include a pipe having an opening. A plug can be disposed in the opening. The tubing assembly can also include a deformable stop. The deformable stop can have a closed position that prevents fluid from flowing from an inner area of the pipe to an outer area of the pipe and from the outer area of the pipe to the inner area of the pipe. The deformable stop can also have a deformed position that prevents fluid from flowing from the inner area of the pipe to the outer area of the pipe.

The foregoing description of the aspects, including illustrated aspects, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed is:

1. A tubing assembly, comprising:

a pressure holding barrier having an opening between a first area and a second area of the pressure holding barrier; and the opening defining a passageway, a deformable stop positioned within the passageway, the deformable stop restricting fluid flow though the passageway, the deformable stop being responsive to a pressure from the first area of the pressure holding barrier above a pre-set threshold by deforming and restricting fluid flow from the first area of the pressure holding barrier to the second area of the pressure holding barrier, wherein the deformable stop is responsive to the pressure from the first area of the pressure holding barrier above the pre-set threshold by deforming such that a diameter of the deformable stop is reduced.

2. The tubing assembly of claim 1, wherein the pressure holding barrier is a pipe and the first area is an inner area of the pipe and the second area is an outer area of the pipe and wherein a plug is positioned within the opening, the plug including a pair of interior walls defining the passageway.

3. The tubing assembly of claim 2, wherein the deformable stop provides a pressure seal between the inner area of the pipe and the outer area of the pipe prior to deforming in response to the pressure from the inner area of the pipe exceeding the pre-set threshold.

4. The tubing assembly of claim 2, wherein the deformable stop that deforms in response to the pressure from the inner area of the pipe exceeding the pre-set threshold also maintains a pressure seal between the inner area of the pipe and the outer area of the pipe when it is deformed.

5. The tubing assembly of claim 2, wherein the deformable stop that deforms in response to the pressure from the inner area of the pipe exceeding the pre-set threshold is responsive to fluid flowing from the outer area of the pipe to the inner area of the pipe by dislodging from the plug.

6. The tubing assembly of claim 5, wherein a flow path is formed from the outer area of the pipe to the inner area of the pipe, through the passageway, in response to the deformable stop dislodging from the plug.

7. The tubing assembly of claim 2, wherein the deformable stop is responsive to the pressure from the inner area of the pipe that is provided in a wellbore from a surface of the wellbore.

8. The tubing assembly of claim 1, wherein the deformable stop includes material having a negative Poisson's ratio.

9. The tubing assembly of claim 1, wherein the deformable stop provides a pressure seal between the first area of the pressure holding barrier and the second area of the pressure holding barrier prior to deforming in response to the pressure from the first area of the pressure holding barrier exceeding the pre-set threshold.

10. The tubing assembly of claim 1, wherein the deformable stop that deforms in response to the pressure from the first area of the pressure holding barrier exceeding the pre-set threshold also maintains a pressure seal between the first area and the second area of the pressure holding barrier when it is deformed.

11. A tubing assembly comprising:

a pipe having an opening;

a plug disposed in the opening, the plug having a cavity defining a flow path through the plug; and a deformable stop disposed within the flow path, the deformable stop restricting fluid flow when in a closed position and when in a deformed position, wherein the deformable stop has a first diameter in the closed position and a second diameter in the deformed position, the second diameter being less than the first diameter.

12. The tubing assembly of claim 11, wherein a shape of the cavity is selected from the group consisting of a hyperboloid, a frustum, an ellipsoid, a spheroid, a cube, a rectangle, and a triangle.

13. The tubing assembly of claim 11, wherein the deformable stop is responsive to a pressure from an inner area of the pipe exceeding a pre-set threshold by deforming into the deformed position and restricting fluid flow from the inner area of the pipe to an outer area of the pipe.

14. The tubing assembly of claim 13, wherein the deformable stop is responsive to the pressure from the inner area of the pipe that is provided in a wellbore from a surface of the wellbore.

15. The tubing assembly of claim 13, wherein the deformable stop that deforms in response to the pressure from the inner area of the pipe exceeding the pre-set threshold is responsive to fluid flowing through the flow path from the outer area of the pipe into the inner area of the pipe by dislodging from the plug.

16. The tubing assembly of claim 15, wherein fluid may flow through the flow path from the inner area of the pipe to the outer area of the pipe in response to the deformable stop being dislodged from the plug.

17. A tubing assembly comprising:

a pipe having an opening; and a plug disposed in the opening;

a deformable stop having a first diameter in a closed position that prevents fluid from flowing from an inner area of the pipe to an outer area of the pipe and from the outer area of the pipe to the inner area of the pipe, the deformable stop having a second diameter in the deformed position that prevents fluid from flowing from the inner area of the pipe to the outer area of the pipe, wherein the second diameter is less than the first diameter.

18. The tubing assembly of claim 17, wherein the deformable stop in the closed position provides a pressure seal between the inner area of the pipe and the outer area of the pipe.

19. The tubing assembly of claim 17, wherein the deformable stop is responsive to a pressure from the inner area of the pipe exceeding a pre-set threshold by deforming into the deformed position.

20. The tubing assembly of claim 19, wherein the deformable stop in the deformed position provides a pressure seal between the inner area of the pipe and the outer area of the pipe and is responsive to fluid flowing from the outer area of the pipe to the inner area of the pipe by dislodging from the plug.

* * * * *